US008398370B1

(12) United States Patent
Liang

(10) Patent No.: US 8,398,370 B1
(45) Date of Patent: Mar. 19, 2013

(54) TURBINE BLADE WITH MULTI-IMPINGEMENT COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 852 days.

(21) Appl. No.: 12/562,164

(22) Filed: Sep. 18, 2009

(51) Int. Cl.
*F01D 5/18* (2006.01)

(52) U.S. Cl. ..... 416/97 R

(58) Field of Classification Search ..... 416/97 A, 416/97 R; 415/115
See application file for complete search history.

(56) References Cited

U.S. PATENT DOCUMENTS 5,813,836 A * 9/1998 Starkweather ..... 416/97 R
5,931,638 A * 8/1999 Krause et al. ..... 416/97 R
7,097,426 B2 * 8/2006 Lee et al. ..... 416/97 R
7,293,961 B2 * 11/2007 Lee et al. ..... 416/96 R
7,296,973 B2 * 11/2007 Lee et al. ..... 416/97 R
7,845,906 B2 * 12/2010 Spangler et al. ..... 416/97 R

* cited by examiner

*Primary Examiner* — Edward Look
*Assistant Examiner* — Jason Davis
(74) *Attorney, Agent, or Firm* — John Ryznic

(57) ABSTRACT

A turbine rotor blade with a cooling circuit that provides for multiple metering and impingement cooling for the entire airfoil. A cooling supply channel delivers cooling air into a leading edge impingement cavity, a row of suction side wall impingement cavities, and a row of pressure side impingement cavities through metering holes to produce impingement cooling for each cavity. Another series of impingement cavities is formed in the trailing edge region and connects with the last impingement cavity in the mid-chord region to cool the trailing edge.

6 Claims, 2 Drawing Sheets

View A-A

TURBINE BLADE WITH MULTI-IMPINGEMENT COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to an air cooled turbine rotor blade.

2. Description of the Related Art Including Information Disclosed Under 37 CFR 1.97 and 1.98

A gas turbine engine includes a turbine with multiple rows or stages of rotor blades and stator vanes that are exposed to a hot gas flow to convert the energy of the gas flow into mechanical energy. It is well known that the turbine efficiency can be increased by passing a higher temperature gas flow into the turbine. The turbine inlet temperature is limited to the material properties of the turbine, especially of the first stage vanes and blades, and to an amount of cooling of these airfoils. Better cooling capability would keep the metal temperature of the airfoils relatively low enough to allow for higher temperature gas flow. Complex cooling circuits have been proposed that include combinations of impingement cooling and convection cooling of the internal metal, and then film cooling on the outer airfoil surface. Of these types of cooling, impingement cooling offers the best heat transfer coefficient.

Another problem with turbine airfoils is maintaining a proper metal temperature of each part of the airfoil. Some surfaces are exposed to higher gas flow temperatures and thus can result in a hot spot on the airfoil. Hot spots can cause early erosion damage that will limit the life period of the airfoil. Especially in an industrial gas turbine engine, part life is an important design criterion since these engines operate on a continuous time period of 48,000 hours without shut down. If a part is worn or damaged, the efficiency of the turbine can be significantly affected. Therefore, cooling of specific parts of the airfoil must also be considered and provided for.

Still another design issue involves the cooling air pressure so that back flow margin (BFM) does not cause problems. BFM is when the external hot gas pressure is greater than the cooling air pressure for a film cooling hole. This situation will result in the hot gas flowing into the airfoil through the film cooling holes. Therefore, the cooling circuit must be tailored for the local pressure distribution to optimize the film cooling. Too little film cooling discharge would result in low cooling protection, while too much film cooling discharge would result in wasted cooling air which also decreases the engine efficiency.

BRIEF SUMMARY OF THE INVENTION

It is an object of the present invention to provide for a turbine rotor blade with multiple metering impingement cooling for the entire airfoil surface of the blade.

It is another object of the present invention to provide for a turbine rotor blade with a well regulated metal temperature.

It is another object of the present invention to provide for a turbine rotor blade with a tailored local pressure distribution to optimize the film cooling of the airfoil.

The above objective and more are achieved with the turbine rotor blade multiple metering and impingement cooling circuit of the present invention. Cooling air is supplied through an airfoil pressure side near the airfoil leading edge feed channel. For the leading edge feed channel, the cooling air is impinged onto the backside surface of the leading edge to provide convection cooling for the airfoil leading edge. The spent cooling air is then discharged through an airfoil showerhead arrangement of film cooling holes and pressure and suction side gill holes. A portion of the leading edge feed channel flow is also impinged onto the airfoil suction side and the spent impingement cooling air is then discharged from the airfoil wall through a row of suction side film cooling holes. A majority of the cooling air is then impinged onto the pressure side cavity next to the leading edge cooling supply cavity. This side wall multiple impingement cooling process repeats along the entire airfoil mid-chord multiple impingement cavities. Rough surfaces are also built into the impingement cavities for enhancement of the internal cooling performance.

Cooling flow rate and pressure are regulated to each impingement cavity for optimization of cavity pressure at various locations of the airfoil. The spent air is then discharged from the pressure side and suction side cavities onto the airfoil external wall to provide airfoil external film cooling. Both the pressure side and the suction side impingement cavity pressure can be divided into separate compartments in the blade spanwise direction for further tailoring the spanwise hot gas side pressure distribution.

DETAILED DESCRIPTION OF THE INVENTION

Figure 1:
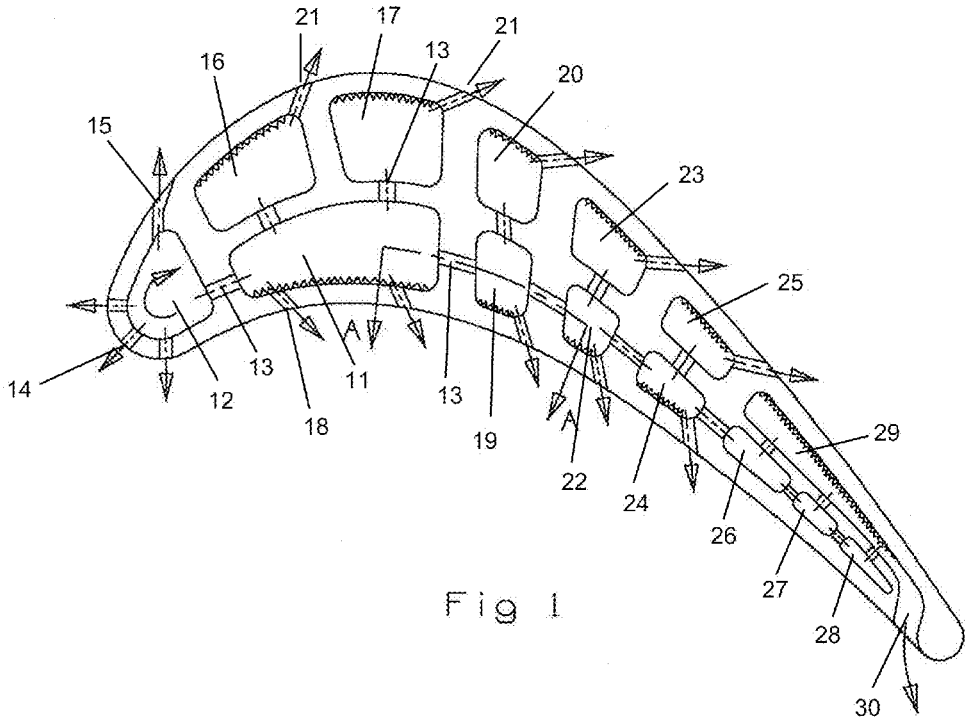
FIG. 1 shows a graph of a cross section top view of the turbine blade cooling circuit of the present invention.
Figure 2:
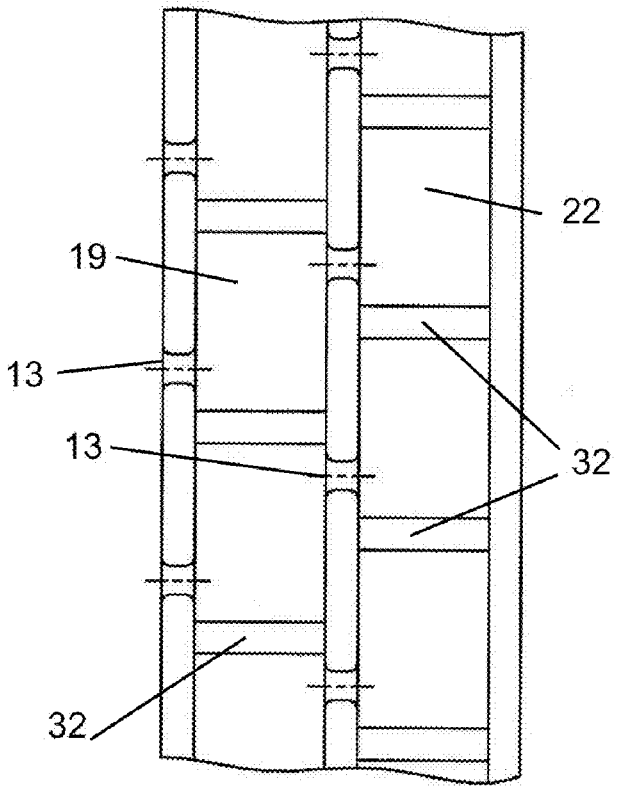
FIG. 2 shows a cross section side view of the multiple compartments impingement cavity through line A-A in FIG. 1.
Figure 3:
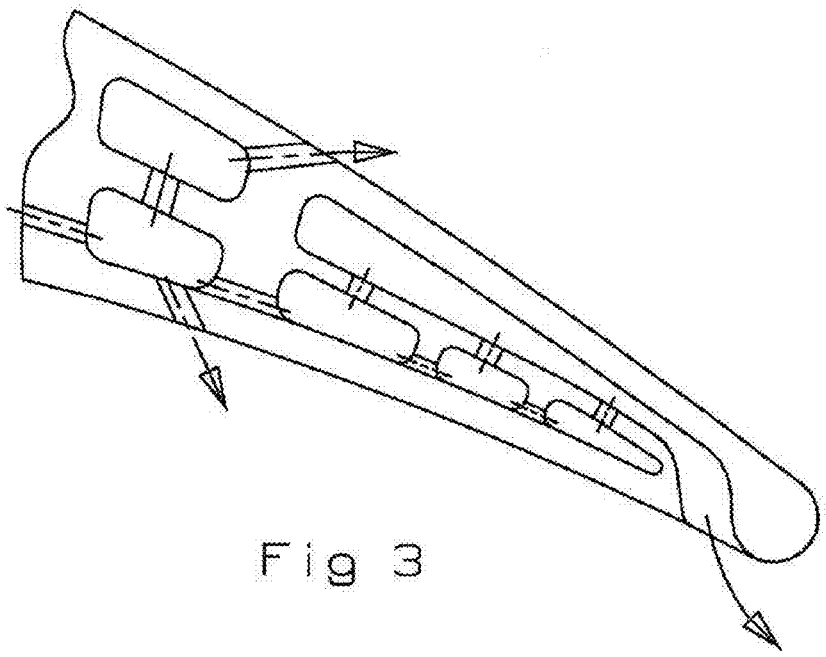
FIG. 3 shows a cross section view of the trailing edge section of the airfoil cooling circuit.

The turbine blade of the present invention is shown in FIGS. 1-3 and includes multiple metering and impingement cooling for the entire airfoil. In FIG. 1, the blade includes a cooling air supply channel 11, a leading edge impingement cavity 12 connected by a metering and impingement hole 13, an arrangement of showerhead film cooling holes 14 opening on the airfoil leading edge surface, a suction side gill hole 15 and several other impingement cavities located along the pressure side wall and the suction side wall all connected together by metering and impingement holes 13. Suction side impingement cavities 16 and 17 are both connected to the supply channel 11 through a separate metering and impingement hole. The pressure side impingement cavities (19, 22, 24) are connected in series by metering and impingement holes. Suction side impingement cavities (20, 23, 25) are connected to the adjacent P/S cavity directly across through a separate metering and impingement hole. Each of the impingement cavities is connected to a film cooling hole 21 to discharge a layer of film cooling air from the cavity.

The trailing edge region of the airfoil includes impingement cavities on the pressure side and the suction side with one longer impingement cavity located on the suction wall side that opens into a row of cooling air exit holes 30 on the pressure side wall adjacent to the trailing edge. P/S impingement cavities (26, 27, 28) are connected in series through metering and impingement holes. S/S impingement cavity 29 is connected to the P/S impingement cavities (26, 27, 28) through metering holes from each of the P/S cavities (26, 27, 28) as seen in FIG. 3.

FIG. 2 shows a section of the cooling circuit in FIG. 1 through line A-A in which two adjacent impingement cavities 19 and 22 are connected by the metering holes such that the metering holes are staggered and not directly lined up. This will prevent the cooling air from passing straight through from one cavity and into the next cavity without producing much of an impingement cooling. Staggering the metering holes will force more air to be impinged onto the wall surface before the air is reorganized to flow through the next metering hole and into the next cavity for impingement cooling.

Each of the cavities and metering holes can be sized such that the pressure and volume of cooling air passing through and into the cavities can be regulated in order to control the cooling and film cooling pressure. The impingement cavities are separated by ribs 32 into multiple separated impingement cavities that extend in the spanwise direction to form separate compartments. This further adds to the tailoring capability of the cooling circuit in that the impingement cavity can be tailored also in the spanwise direction of the airfoil.

The cooling circuit of the present invention operates as follows. Cooling air is supplied to the cooling supply channel 11 and flows into the adjacent cooling cavities on the leading edge wall, the suction side wall and the pressure side wall through the associated metering holes to produce impingement cooling in the impingement cavity. Cooling air also flows out through the two rows of film cooling holes 18 in the cooling supply channel 11.

Cooling air from supply channel 11 flows into the L/E impingement cavity through the metering and impingement hole 13, and from this cavity through the film holes and gill holes to produce a layer of film cooling air for the leading edge. Cooling air from the supply channel 11 also flows into the two adjacent S/S impingement cavities 16 and 17 through the associated metering hole to produce impingement cooling on the backside wall of the S/S wall. The cooling air in these S/S cavities 16 and 17 is discharged through the rows of film cooling holes associated with each impingement cavity.

Most of the cooling air from the supply channel 11 is metered into the adjacent P/S impingement cavity 19 and then flows to the remaining impingement cavities of the rest of the airfoil. S/S impingement cavity 20 is connected to the P/S impingement cavity 19 through the metering hole to produce impingement cooling, the spent cooling air then being discharged through the row of film cooling holes onto the suction side wall. Cooling air from P/S impingement cavity 19 flows in series along the impingement cavities along the pressure side wall (22, 24) through metering holes. P/S cavities are connected to adjacent S/S impingement cavities through the metering holes (that also produce impingement cooling). Each P/S and S/S impingement cavity also includes a row of film cooling holes to discharge the spent impingement cooling air.

The last P/S impingement cavity 24 is connected to the T/E cooling circuit that includes P/S impingement cavities (26, 27, 28) that each are connected to the one long S/S impingement cavity 29 through separate metering holes. The spent impingement cooling air from the long S/S impingement cavity 29 is discharged out through the row of P/S exit slots 30.

To enhance the internal cooling performance, rough surfaces are formed on the outer walls of each impingement cavity. The cooling flow rate and pressure are regulated for each impingement cavity by sizing the metering hole for optimization of the cavity pressure at various locations along the airfoil. The spent cooling air is then discharged from the cavities onto the airfoil external surface to provide airfoil external film cooling. Both the P/S and S/S impingement cavity pressure can be formed into separate compartments in the blade spanwise direction for tailoring the spanwise hot gas side pressure distribution.

The multiple metering and impingement process repeats along the airfoil trailing edge section. A triple impingement cooling process on the pressure side trailing edge region impinges cooling air onto the airfoil suction side inner wall for cooling of the T/E portion. Spent cooling air is then discharged from the airfoil suction side T/E impingement cavity through a row of short P/S bleed slots.

I claim the following:

1. A turbine rotor blade comprising:

an airfoil with a leading edge region, a trailing edge region, and a mid-chord region located between the leading edge region and the trailing edge region;

a leading edge impingement cavity located in the leading edge region to provide impingement cooling for a backside surface of the leading edge wall of the airfoil;

a plurality of pressure side impingement cavities located along the pressure side wall in the trailing edge region and connected by metering holes in series;

a long suction side impingement cavity located along the suction side wall in the trailing edge region and connected to the plurality of pressure side impingement cavities through separate metering holes;

a cooling supply channel located along the pressure side wall in the mid-chord region of the airfoil and adjacent to the leading edge impingement cavity;

a plurality of pressure side impingement cavities located along the pressure side wall in the mid-chord region connected in series by metering holes and connected to the cooling supply channel;

a plurality of suction side impingement cavities located along the suction side wall in the mid-chord region and connected to the cooling supply channel or the series of pressure side wall impingement cavities through a separate metering hole;

the impingement cavities in the trailing edge region being connected to the last pressure side wall impingement cavity in the mid-chord region; and, the impingement cavities and cooling supply channel in the mid-chord region being connected by film cooling holes to discharge spent impingement cooling air from the cavity as film cooling air.

2. The turbine rotor blade of claim 1, and further comprising:

the trailing edge includes three pressure side wall impingement cavities connected in series that supply the long suction side impingement cavity with cooling air.

3. The turbine rotor blade of claim 1, and further comprising:

the pressure side impingement cavities and cooling supply channel are separated from the suction side impingement cavities in the mid-chord region by a chordwise extending rib that passes along the middle of the airfoil.

4. The turbine rotor blade of claim 1, and further comprising:

the pressure side wall impingement cavities in the mid-chord region include three impingement cavities; and, each of the three pressure side impingement cavities supplied cooling air to a suction side impingement cavity through metering holes.

5. The turbine rotor blade of claim 1, and further comprising:

the long suction side impingement cavity being connected to a row of exit slots on the pressure side wall.

6. The turbine rotor blade of claim 5, and further comprising:

the impingement cavities in the trailing edge all discharge the spent impingement cooling air out through the row of exit slots.

* * * * *